US005556341A

United States Patent [19]

Bonn, Jr.

[11] Patent Number: 5,556,341

[45] Date of Patent: Sep. 17, 1996

[54] BILLIARD BALL RACK

[76] Inventor: Russell H. Bonn, Jr., 10508 Towner, NE., Albuquerque, N.M. 87112

[21] Appl. No.: 568,194

[22] Filed: Dec. 6, 1995

[51] Int. Cl.[6] ..... A63D 15/00

[52] U.S. Cl. ..... 473/40

[58] Field of Search ..... 433/40, 41

[56] References Cited

U.S. PATENT DOCUMENTS

| | | | |
|---|---|---|---|
| 916,193 | 3/1909 | Pierce | 473/40 |
| 1,052,461 | 2/1913 | Chase | 273/22 |
| 1,089,140 | 3/1914 | Madigan | 273/22 |
| 1,725,494 | 8/1929 | Varnum | 273/22 |
| 2,405,677 | 8/1946 | Volpe | 273/22 |
| 3,253,826 | 5/1966 | Cook | 473/40 |
| 3,992,005 | 11/1976 | Richey | 273/22 |
| 4,553,750 | 11/1985 | Kintz | 473/40 |
| 4,903,965 | 2/1990 | Smith | 273/22 |

*Primary Examiner*—Mark S. Graham
*Attorney, Agent, or Firm*—Dennis F. Armijo

[57] ABSTRACT

A billiard rack wherein balls are compressed towards the center of the rack from all sides of the rack simultaneously. The billiard ball rack has a retractable actuator that activates packing bars to compress the balls, and resets the packing bars to their original position after compression. The packing bars have an angled edge for seating the balls into the table surface when the retractable actuator is actuated. Additionally, a method of compacting balls by urging the balls from at least three sides to the center of a frame.

16 Claims, 3 Drawing Sheets

BILLIARD BALL RACK

BACKGROUND OF THE INVENTION

1. Field of the Invention (Technical Field)

The present invention is a billiard ball rack for compactly arranging billiard balls on a table.

2. Background Art

Billiards refers to a number of different games played with a cue stick and hard balls on a table covered with cloth. The most common version of billiards is pocket billiards, also known as pool, in which fifteen balls are used. At the start of the game, the balls are placed on the table in a compact triangular shape followed by the "breaking" of the balls with the cue ball. A billiard ball rack is typically used to organize the balls into a triangular shape and then to position them on the table. The rack is generally larger than the arranged balls, so that the balls can be placed inside the rack. The balls must then be compressed into a compact triangular shape by mechanical means and/or manually. Usually, this is done by the user pushing the bottom row of balls towards the apex of the triangular rack. The rack must be removed very carefully if the player wishes to avoid jostling any of the balls out of position. In practice, this can be a problem even when the player exercises great care.

Several U.S. patents disclose various kinds of billiard racks designed to mitigate this problem.

U.S. Pat. No. 1,052,461 to Chase, describes a rack comprising three fixed bars which form an equilateral triangle. Located inside the triangle and attached to one of the bars is a presser bar which can be moved forward to squeeze the balls towards the apex of the triangle. The inner faces of the bars are beveled downward in order to avoid disturbing the balls after they have been set up.

U.S. Pat. No. 1,089,140 to Madigan, describes a rack in which two side arms swivel about either end of a base arm. The two side arms can be latched at the apex of the triangle formed by the three arms, and an additional presser bar which pivots out from the base arm is used to force the balls into a compact arrangement.

U.S. Pat. No. 1,725,494 to Varnum, claims a pool-ball rack comprising a base with side members hinged to each end of the base, so that when the free ends of the side members are brought together the balls are compressed together into the conventional triangular arrangement.

U.S. Pat. No. 2,405,677 to Volpe, describes two side bars and a rear cross bar which are rigidly connected together to form an equilateral triangle. A ball adjusting tube is attached to the rear cross bar permitting the balls to be manually pressed together. In order to minimize any disturbance in the position of the balls when the rack is removed, the inner surfaces of the side bars are recessed, resulting in added clearance for the balls.

U.S. Pat. No. 3,992,005 to Richey, claims a rack comprising three interconnecting arms connected by two hinges as well as a ball and socket joint that is constructed to pop open when the last ball is inserted into the triangle formed by the three arms.

U.S. Pat. No. 4,903,965 to Smith, claims a pool rack comprising a frame in the shape of an equilateral triangle. A push bar operated by push buttons is attached to one of the sides. Through manual operation of the push buttons, the push bar is pressed against the balls towards the apex thereby squeezing them together.

None of these devices discloses multiple compression bars acting simultaneously from all three sides of the billiard rack, thereby applying force equally from all three directions by forcing the balls to the center. All of these devices suffer from the same deficiency of forcing the balls towards one or more corners of the triangle, usually causing the balls to be moved when the rack is removed. The present invention avoids the problem of disturbing the balls during rack removal. In addition, a user simply pushes down on the retractable actuator to pack the balls. Accordingly, there is a need for a billiard ball rack that compresses the balls by applying force symmetrically from all directions.

SUMMARY OF THE INVENTION (DISCLOSURE OF THE INVENTION)

In accordance with the present invention, there is provided a billiard ball rack for compactly arranging and positioning billiard balls on a table. The preferred invention comprises a three-sided frame and pushing means for urging a group of billiard balls towards the center of the frame. The pushing means acts simultaneously from all three sides of the frame so that the balls are urged towards the center of the frame rather than against one or two sides of the frame as with conventional billiard ball racks. This aspect of the invention not only simplifies the process of compacting the balls, but also minimizes the chance that the balls will be jostled or disturbed when the rack is removed from the balls.

The preferred invention comprises packing bars which emerge from all three sides of the frame to urge the balls towards the center of the frame. The packing bars preferably meet the balls above their center of gravity in order to keep the balls securely on the table. The balls are most easily compacted when the packing bars have an inclined or beveled edge that contacts the balls, since this tends to seat the balls into the cloth of the table. A recessed or inclined surface on the packing bars also results in greater clearance for the rack as it is removed from the balls.

The packing bars are preferably engaged by a retractable actuator that surrounds the frame. By depressing the retractable actuator, the packing bars are urged towards the center of the frame, thereby forcing the balls into a compact, triangular shape. In the preferred embodiment of the invention, the retractable actuator has a beveled face that contacts the outer edge of the packing bars. As the retractable actuator is depressed, the beveled face of the retractable actuator forces the packing bars towards the center of the frame.

The preferred embodiment of the invention also comprises spring means interfacing the pushing means with the retractable actuator. The spring means acts to return the retractable actuator and the pushing means to their original positions after the balls have been positioned.

An object of the present invention is to enable the billiards player to quickly set up the balls in a way that does not depend upon his dexterity.

Another objective is to allow the unskilled player to position the balls in a simple and fool proof manner with a minimum of frustration.

A primary advantage of the invention is that the balls are forced towards the center of the rack by closing in on them mechanically from all three sides, thereby greatly simplifying the task of setting up the balls and minimizing the possibility that any of the balls will be jiggled when the rack is removed.

Another advantage of the invention is that the packing bars are cut at a slight angle, so that the balls are gently seated into the felt of the table.

Yet another advantage of the invention is that the packing bars are recessed below the center of the billiard balls, thereby resulting in greater clearance as the rack is removed.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
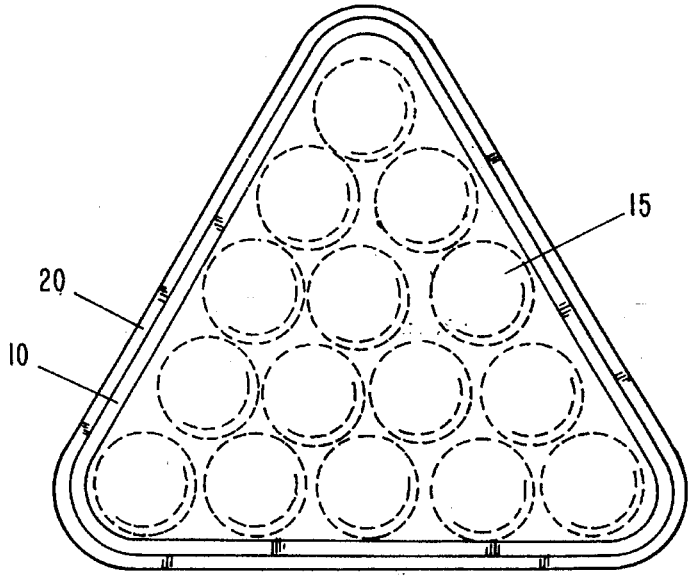
FIG. 1 is a top view of the preferred embodiment of the invention with balls loosely grouped within it.
Figure 2:
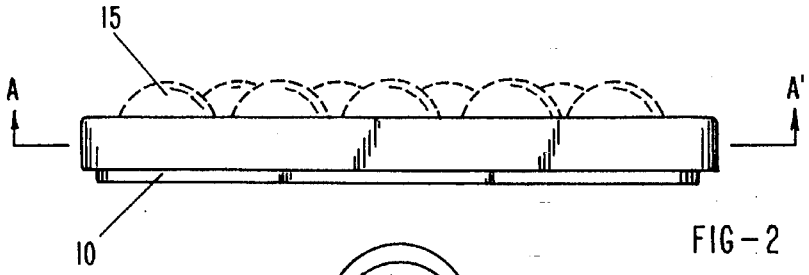
FIG. 2 is a side view of the embodiment of the invention shown in FIG. 1.
Figure 3:
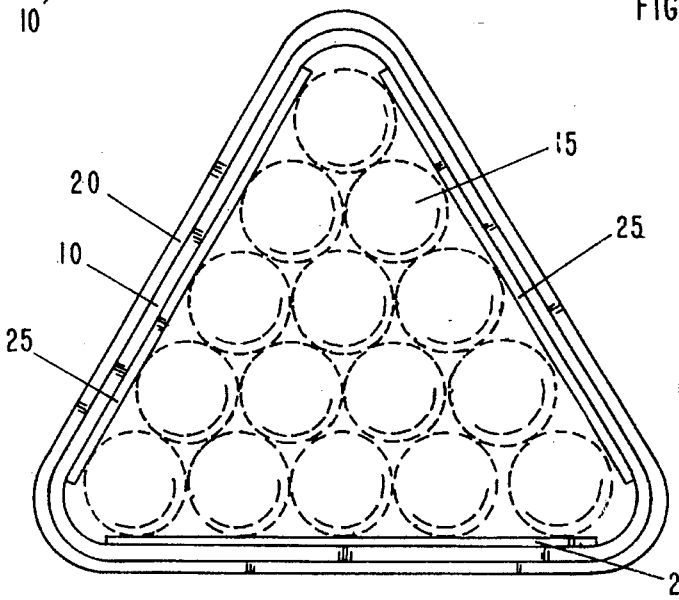
FIG. 3 is a top view of the preferred embodiment of the invention when activated.
Figure 4:
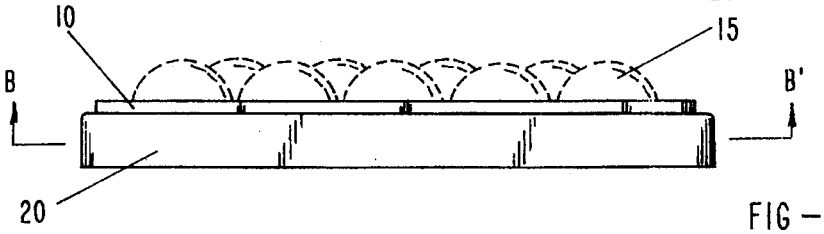
FIG. 4 is a side view of the embodiment of the invention shown in FIG. 3.

As shown in the accompanying drawings, the present invention is directed to a billiard ball rack for compactly arranging billiard balls on a table. Although the description refers only to billiard ball racks, this disclosure also encompasses pool racks for 15 ball games as well as other games such as 9 ball. In one embodiment of the invention shown in FIGS. 1 and 2, a triangularly shaped frame 10 that fits loosely around a group of billiard balls 15 is surrounded by a retractable actuator 20 that operates in the vertical direction. As seen in FIGS. 3 and 4, when retractable actuator 20 is depressed, packing bars 25 emerge simultaneously from all three sides of frame 10 to press balls 15 towards the center of frame 10.

Figure 5:
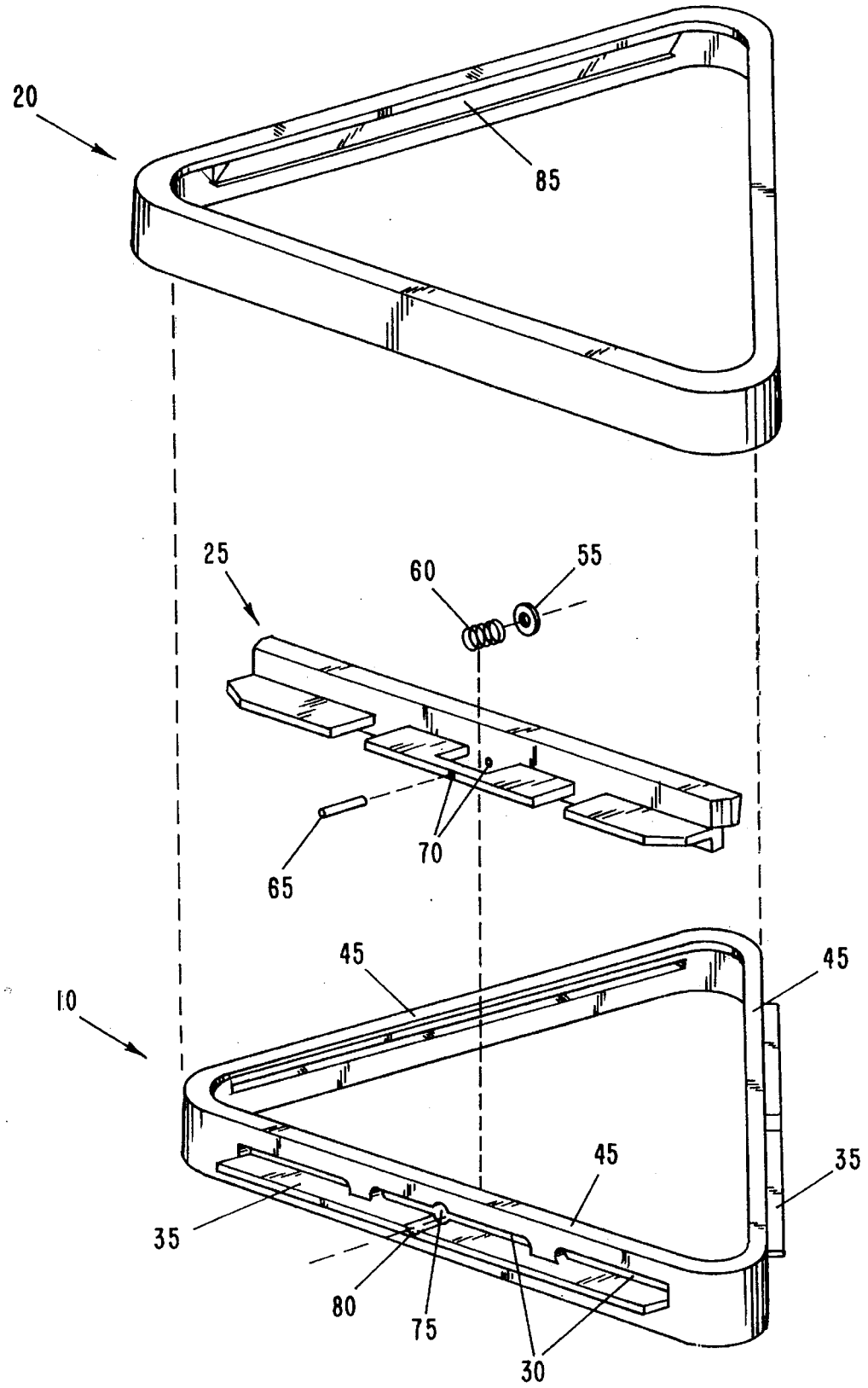
FIG. 5 is an articulated view of the preferred embodiment of the invention.
Figure 6:
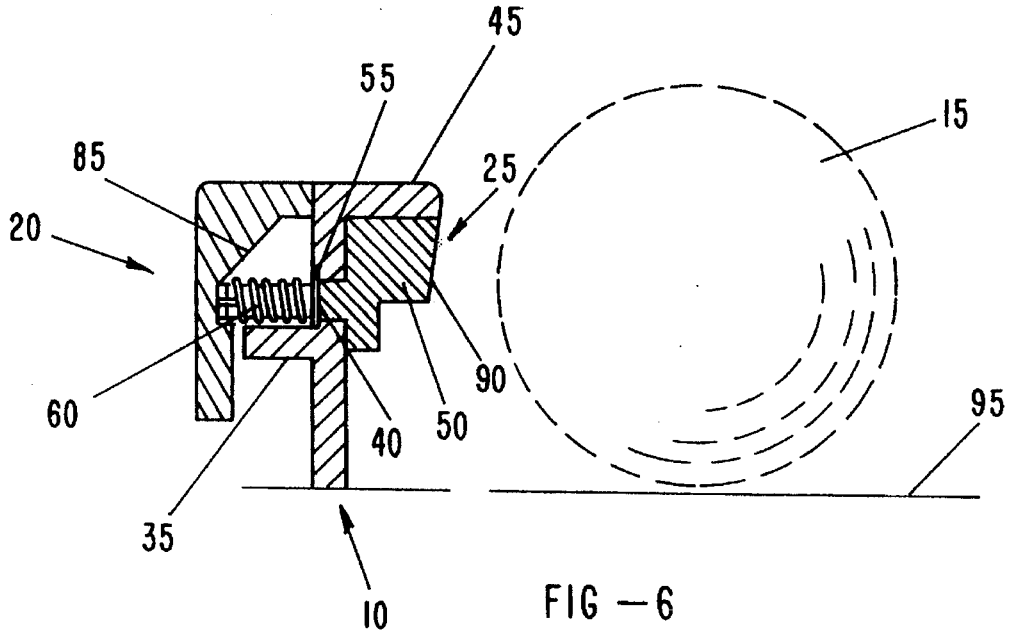
FIG. 6 is a cross-sectional view of one end of the invention shown in FIG. 2 along axis A–A'.
Figure 7:
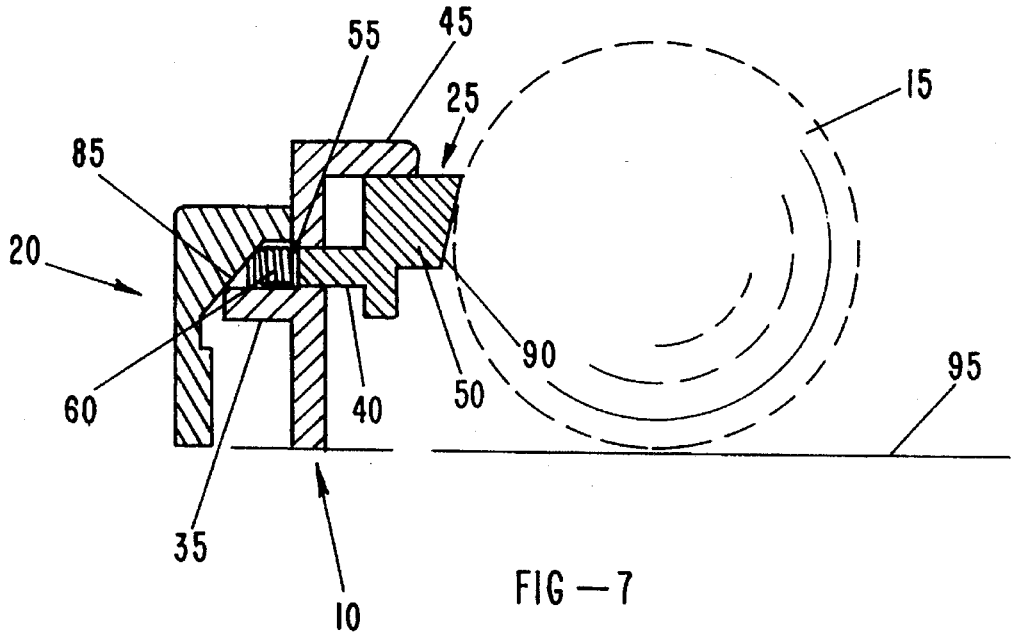
FIG. 7 is cross-sectional view of one end of the invention shown in FIG. 4 along axis B–B'.

The relationship between frame 10, retractable actuator 20, and packing bars 25 is indicated more clearly in FIG. 5 and by the cross sectional views in FIGS. 6 and 7. Slits 30 in each side of frame 10 permit movement of packing bar 25. Each side of frame 10 has a first lip 35 extending out from the outer face of frame 10 over which slab 40 of packing bar 25 can slide and is supported. Second lip 45 of frame 10 extends from the inner face of frame 10 towards the center of frame 10 and substantially matches the height of packing bar push member 50 of packing bar 25. This way packing bar push member 50 of packing bar 25 always remains inside frame 10. Washer 55 that is mated with spring 60 and spring rod 65 keeps packing bar 25 positioned within the interior of frame 10. Washer 55 is situated on the outside of frame 10 and surrounds spring rod 65 that is mounted into holes 70 in frame 10, whereas spring 60 fits around spring rod 65. Washer 55 rests in washer groove 75, and spring rod 65 rests in spring rod groove 80. Alternatively, spring rod 65 can be replaced by a set screw surrounded by a piece of plastic, in which case the set screw is secured into holes 70 (not shown). Alternatively, a spring or similar apparatus can be placed into a molded encagement on the frame using injection molding techniques, or other spring loading techniques can be utilized to secure and actuate the packing bars, which are well known in the art (not shown). Although spring 60 shown in FIGS. 5–7 is a spiral spring, other kinds of springs such as coil springs, leaf springs, and volute springs can be used in alternative embodiments of the invention.

Packing bars 25 are urged into the center of frame 10 by retractable actuator 20 by means of a beveled face 85 in retractable actuator 20, which is seen in FIG. 5 but illustrated more clearly in FIGS. 6 and 7. Retractable actuator 20 is seen in its normal, relaxed position in FIG. 6, where spring 60 is expanded. As retractable actuator 20 is depressed, spring 60 is compressed and slab 40 of packing bar 25 is pushed towards the center of frame 10, so that packing bar push member 50 contacts and urges balls 15 toward the center of frame 10, as shown in FIG. 7. As retractable actuator 20 is being actuated, packing bars 25 contact beveled face 85 at points progressively closer to packing bars 25, so that packing bars 25 are continually forced towards the center of frame 10. Packing bar push member 50 extends above and below slab 40 of packing bar 25 and slit 30, so that packing bar push member 50 properly mates with second lip 45 of frame 10. In addition, packing bar push member 50 has a contact surface 90 that has an angled edge that acts to seat balls 15 into table 95 when packing bars 25 are activated, as shown in FIGS. 6 and 7. This is accomplished when contact surface 90 contacts balls 15 at a point above their center of gravity. Contact surface 90 also provides additional clearance for the rack as the rack is removed, thereby minimizing the chance that balls 15 will be jostled after they have been pressed into a compact triangle. This disclosure is not limited to this embodiment for pushing the packing bars. Other alternative embodiments can be utilized such as spring loaded trigger mechanisms, rachet mechanisms, or other well known apparatuses and methods can be used.

When retractable actuator 20 is engaged (depressed), spring 60 is compressed. Thus, after balls 15 have been forced into a compact triangle, spring 60 acts to return packing bars 25 to their original, unextended position, and retractable actuator 20 is likewise restored to its original, raised position. Although, actuator 20 herein describes being actuated by being depressed, similar apparatuses can be utilized to actuate packing bars 25 such as vertical pressure structures or push buttons.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art, and it is intended to cover in the appended claims all such modifications and equivalents. The entire disclosures of all references, applications, patents, and publications cited above, and of the corresponding application(s), are hereby incorporated by reference.

What is claimed is:

1. A billiard ball rack for arranging balls on a table into a compact predetermined arrangement of balls, comprising:

a frame comprising at least three sides, said frame being large enough to surround loosely grouped balls; and packing bar means affixed to said frame for pushing the balls away from said at least three sides towards a center of said frame.

2. The invention of claim 1, further comprising retractable actuator means for activating said packing bar means.

3. The invention of claim 2, wherein said retractable actuator means comprises spring means.

4. The invention of claim 3, wherein said spring means comprises a member selected from the group consisting of coil springs, leaf springs, spiral springs, and volute springs.

5. The invention of claim 1, wherein said packing bar means comprises a contact surface, said contact surface meeting the balls at a point above each ball's center of gravity.

6. The invention of claim 5, wherein said contact surface comprises an angled edge for seating the balls into a table surface.

7. The invention of claim 1, wherein said packing bar means for pushing the balls away from said at least three sides towards said frame's center comprises an apparatus for simultaneously pushing the balls.

8. A billiard ball rack for arranging balls on a table into a compact predetermined arrangement of balls, comprising:

a frame comprising at least three sides, said frame being large enough to surround loosely grouped balls;

packing bars affixed to said frame for urging the balls towards a frame's center;

retractable actuator for each respective packing bar for pushing a respective said packing bar, said retractable actuator for each respective packing bar comprising an apparatus that simultaneously and progressively urges a respective said packing bar towards said frame's center upon activation and returns said respective packing bar to an original position when deactivated.

9. The invention of claim 8, wherein each said retractable actuator comprises a vertical retractable actuator.

10. The invention of claim 9, wherein each said retractable actuator comprises:

a beveled face such that when each said retractable actuator is activated, a respective said packing bar contact said beveled face at points progressively closer to said packing respective bar, said beveled face thereby pushing said respective packing bar away from said retractable actuator towards said frame's center;

each of said at least three sides has at least one slit therein and comprises inner and outer faces and first and second lips, said first lip being located underneath said slit and extending from said outer face away from said frame's center, said second lip being located above said slit and extending from said inner face towards said frame's center; and each of said packing bars comprises at least one rod that passes through said slit and over said first lip, each of said packing bars further comprising at least one packing bar push member that extends both above and below said rod, said packing bar push member facing said inner face and being substantially adjacent to said second lip, said packing bar push members acting to keep said packing bars inside said frame.

11. The invention of claim 8, wherein said packing bars comprise a contact surface, said contact surface meeting the balls at a point above each ball's center of gravity.

12. The invention of claim 11, wherein said contact surface comprises an angled edge for seating the balls into a table surface.

13. A method of arranging billiard balls on a table into a compact predetermined arrangement of balls, the method comprising the steps of:

a) surrounding loosely grouped balls within an at least three sided frame; and b) compacting the balls in a center of the at least three sided frame packing bars comprising pushing the balls away from the at least three sides towards the center.

14. The method of claim 13 wherein the step of compacting the balls in a center of the at least three sided frame comprises activating a retractable actuator for each packing bar.

15. The method of claim 14 wherein the step of activating a retractable actuator for each packing bar comprises simultaneously engaging at least three substantially similar packing bars, each packing bar affixed to a side of the at least three sided frame.

16. The invention of claim 14 wherein the step of activating a retractable actuator for each packing bar comprises pressing the retractable actuator.

* * * * *